US005881478A

United States Patent [19]

McMahon et al.

[11] Patent Number: 5,881,478

[45] Date of Patent: Mar. 16, 1999

[54] MIDSOLE CONSTRUCTION HAVING A ROCKABLE MEMBER

[75] Inventors: Thomas A. McMahon, Wellesley, Mass.; John Healy, Madbury, N.H.

[73] Assignee: Converse Inc., North Reading, Mass.

[21] Appl. No.: 6,082

[22] Filed: Jan. 12, 1998

[51] Int. Cl.[6] ..... A61F 5/14; A43B 5/00; A43B 13/18

[52] U.S. Cl. ..... 36/144; 36/31; 36/127; 36/28

[58] Field of Search ..... 36/142, 143, 144, 36/117.2, 117.5, 116, 31, 28, 127

[56] References Cited

U.S. PATENT DOCUMENTS

| | | | |
|---|---|---|---|
| 2,096,500 | 10/1937 | McCahan et al. | 36/144 |
| 4,237,625 | 12/1980 | Cole et al. | 36/28 |
| 4,241,523 | 12/1980 | Daswick | 36/30 R |
| 4,407,079 | 10/1983 | Chiroff | 36/132 X |
| 4,589,216 | 5/1986 | Fuscone | 36/32 R |
| 4,794,707 | 1/1989 | Franklin et al. | 36/107 |
| 4,881,328 | 11/1989 | Yung-Mao | 36/28 |
| 4,887,367 | 12/1989 | Mackness et al. | 36/28 |
| 4,890,398 | 1/1990 | Thomasson | 36/114 |
| 4,897,936 | 2/1990 | Fuerst | 36/30 A |
| 4,910,884 | 3/1990 | Lindh et al. | 36/28 |
| 4,918,838 | 4/1990 | Chang | 36/28 |
| 5,090,139 | 2/1992 | Germann | 36/117.5 |
| 5,105,565 | 4/1992 | Barret | 36/117.2 |
| 5,212,894 | 5/1993 | Paparo | 36/127 X |
| 5,255,451 | 10/1993 | Tong et al. | 36/30 A |
| 5,313,717 | 5/1994 | Allen et al. | 36/28 |
| 5,445,384 | 8/1995 | Yancey | 36/127 X |
| 5,689,902 | 11/1997 | Juang | 36/28 X |

*Primary Examiner*—B. Dayoan
*Attorney, Agent, or Firm*—Howell & Haferkamp, L.C.

[57] ABSTRACT

A shoe having a resilient sole, an upper secured to the sole, and a rockable member within a cavity in the sole. The rockable member is configured for side-to-side rocking in the sole cavity between a neutral position and a tilted position as the wearer's foot is moved relative to the sole between a neutral position and a tilted position.

24 Claims, 2 Drawing Sheets

MIDSOLE CONSTRUCTION HAVING A ROCKABLE MEMBER

BACKGROUND OF THE INVENTION

This invention relates to the construction of shoes generally, and more particularly to an athletic shoe sole construction having a rockable member that rocks as a wearer applies sidewardly directed forces through his or her foot to the shoe sole.

The sole of a shoe is subject to a variety of forces, both static and dynamic, as its wearer moves about. Static forces applied to the sole may vary from a vertical load relative to the top surface of the sole, for example when the wearer stands on a horizontal surface, to mixed vertical and horizontal loads relative to the sole, for example when the wearer stands on a sloped surface. The dynamic forces may likewise vary from a vertical load, such as when the wearer lands after a vertical jump, to mixed horizontal and vertical forces relative to the sole, such as when the wearer plants his or her foot to change direction. Finally, the static and dynamic forces may vary with the size and weight of the wearer and the wearer's activity level. A casual walker will exert relatively modest forces, while an athlete in competition or in training will exert relatively large forces to the shoe sole.

Although conventional shoe soles may comfortably support the foot and adequately bear the vertical forces of the wearer, shoe soles are ill-equipped to adequately bear the horizontal forces of the wearer. Consequently, as horizontal forces are applied to the sole, the foot tends to slip along the top surface of the sole. This slipping is considerably more pronounced when the shoes are used for athletic purposes, and affects the performance of the shoe. Such slipping also contributes to fatigue and ultimately fosters injury.

In addition to possible injury, fatigue and compromised athletic performance, lateral (i.e., side-to-side) sliding of the foot over the sole has other deleterious effects. It may reduce the comfort of the wearer and induce blisters and irritation of the forefoot. The sliding effect may also reduce shoe life. Repetitive sliding against the upper wall may cause the upper to tear from the sole. Thus, whenever a shoe is used in a manner requiring abrupt lateral changes of direction, the lateral sliding of the forefoot adversely affects the performance of the wearer and the performance of the shoe.

SUMMARY OF THE INVENTION

Among the objects of the present invention may be noted the provision of a shoe sole construction that causes the forefoot to tilt medially inward to reduce the inversion angle of the ankle and forefoot and thereby improves athletic performance when the wearer accelerates or decelerates laterally (i.e., in a side-to-side direction); the provision of such a shoe sole construction which does not compromise the ability of the shoe to flex at the ball of the foot; the provision of such a shoe that prevents the foot from sliding laterally over the top of the shoe sole and thereby increases shoe comfort and reduces the likelihood of injury; and the provision of a shoe that prolongs the life of the shoe by reducing the stress and shearing forces applied to the side walls of the upper.

Generally, the shoe of the present invention comprises a resilient sole, an upper and a rockable member. The sole supports a foot of a wearer and has a heel portion, a forefoot portion, and a cavity. The upper is secured to the sole. The rockable member is within the sole cavity and is configured for side-to-side rocking relative to the sole between a neutral position and a tilted position as the foot of the wearer is moved relative to the sole from between a neutral position and a tilted position.

In another aspect of the present invention, a shoe comprises a sole, an upper, and a rotatable member. The sole has a forefoot portion and a heel portion. The forefoot portion has a medial region and a lateral region. The sole further has an outer bottom surface engageable with a surface, such as a playing field or court. The upper is secured to the sole. The rotatable member is adjacent the forefoot portion and is configured for rotational movement relative to the sole between a neutral position and a tilted position. The rotatable member has a medial end generally adjacent the medial region of the forefoot portion, and a lateral end generally adjacent the lateral region of the forefoot portion. The medial end is spaced a first vertical distance from the bottom surface of the sole when the rotatable member is in its neutral position, and spaced a second vertical distance from the bottom surface of the sole when the rotatable member is in its tilted position. The second vertical distance is less than the first vertical distance.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
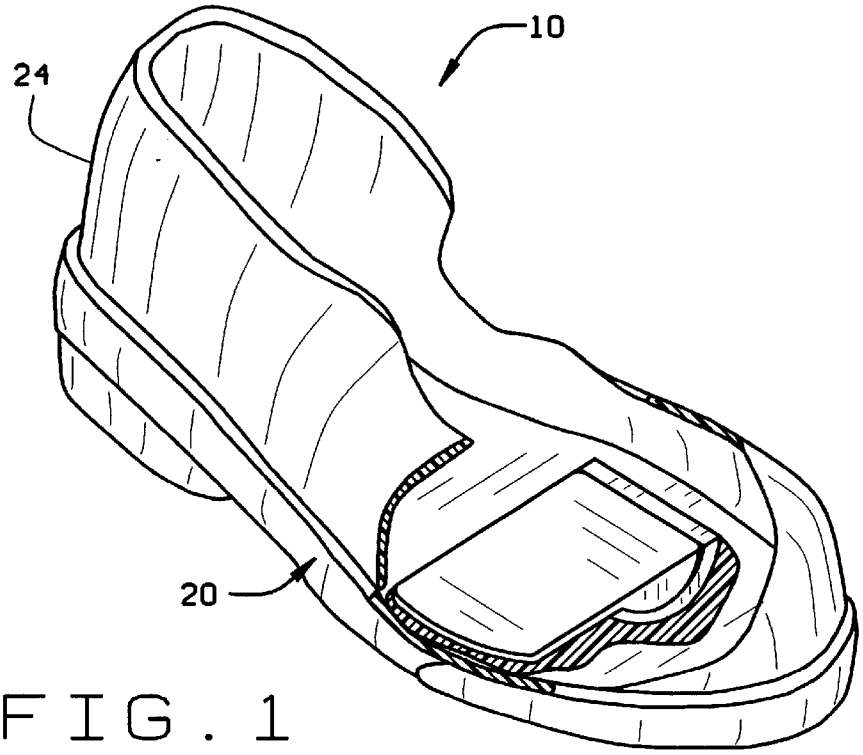
FIG. 1 is a perspective view of a shoe construction of the (present invention with portions broken away to show a rockable member in the shoe sole.

Referring now to the drawings, a shoe construction of the present invention is indicated in its entirety by the reference numeral 10. The shoe comprises a sole, generally designated at 20. Attached to the sole 20 is an upper 24, which may be made of a variety of materials, including but not limited to leather, canvas and suede.

Figure 2:
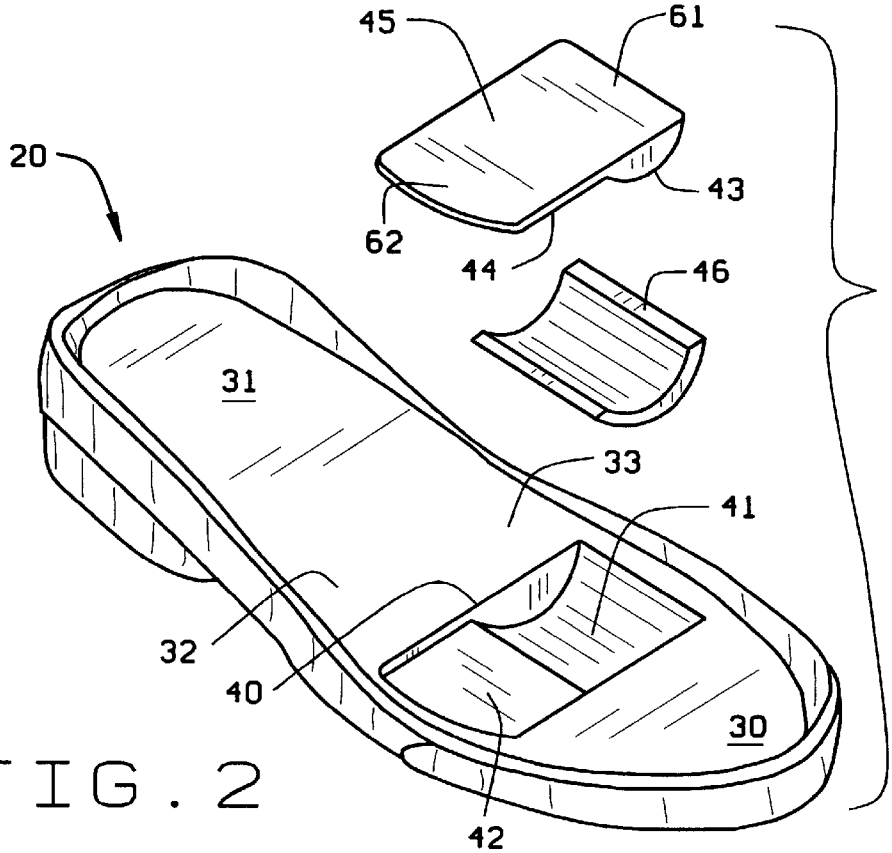
FIG. 2 is an exploded view of the shoe sole construction of FIG. 1.

Preferably, the sole 20 comprises a midsole 22 and an outsole 23. The midsole 22 is preferably of one or more conventional cushioning materials such as foam ethylene vinyl acetate (EVA), foam polyurethane (PU), and other suitable materials. The outsole 23 is preferably of a durable material, such as carbon rubber, and has an outer bottom surface 52 engageable with a surface, such as a playing field, basketball court, tennis court, etc. As is best seen in FIG. 2, the sole 20 has a forefoot portion 30 and a heel portion 31. The sole also includes a lateral region 32 and a medial region 33. The lateral and medial regions 32, 33 of the sole correspond to a lateral (outside) region of the foot 34 and a medial (inside) region of the foot 35, respectively, as the shoe is worn. Stated another way, the lateral region 32 of the sole 20 is the region of the sole which supports the fifth metatarsal of the wearer's foot, and the medial region 33 is the region of the sole which supports the first metatarsal of the wearer's foot.

A cavity 40 is formed in the forefoot portion 30 of the sole 20. The cavity 40 substantially spans the width of the forefoot portion of the sole 20. It has a curved concave portion 41 and an flat portion 42. The concave and flat portions 41, 42 are configured to receive a curved convex portion 43 and flat portion 44 of the bottom of a rockable (or rotatable) member 45. The rockable member 45 may be made of a relatively rigid solid elastomer, e.g., polyurethane, polyvinylchloride, or other thermoplastic. Alternatively, the rockable member 45 may be made of layered flexible thermoplastics and synthetic foams such as EVA or PU foam so that the rockable member has a rigid core and a soft upper surface. The rockable member 45 must be sufficiently rigid to support the foot of a wearer in a tilted position. Preferably, the rockable member 45 is made of a semi-rigid plastic, either injected or thermally formed such as nylon, peebax, or polyurethane. The rockable member 45 of the preferred embodiment maintains a relatively rigid structure yet retains its cushioning properties.

A flexible coupling element 46 is positioned between the concave portion 41 of the sole cavity 40 and the convex curved portion 43 of the rockable member 45. The coupling element may be made of an elastomeric solid, a gel, or a membrane containing a liquid, solid or gas. Preferably, the coupling element is of a soft, elastic PU (shore 000=50) or other-material that has relatively low shear resistance and deforms when a load is applied to its surface. The material returns to its original shape once the load is removed. The purpose of the coupling element 46 is to rockably connect the rockable member 45 to the sole 20. The coupling element is configured to deform in a manner to allow the rockable member 45 to displace in the concave portion 41 of the sole cavity 40. To ensure that the rockable member operates satisfactorily, the coupling element 46 is preferably adhered to or otherwise attached to the sole cavity to keep the coupling element from moving relative to the cavity and impeding the rocking action of the rockable member.

Figure 3:
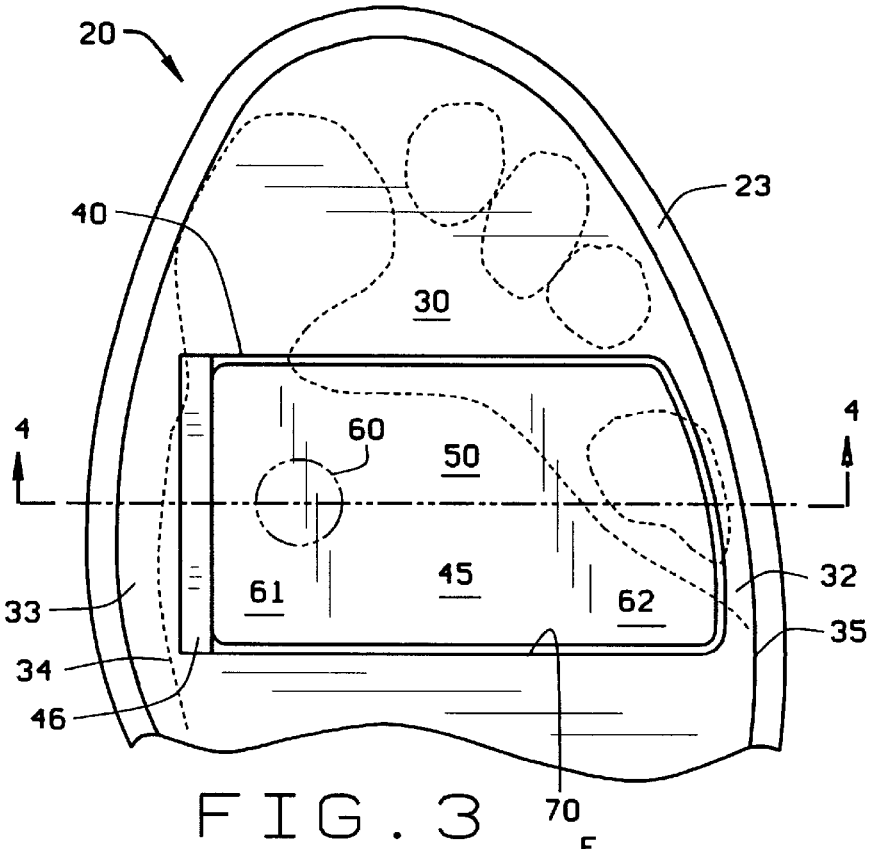
FIG. 3 is fragmented top view of the shoe construction of FIG. 1.
Figure 4:
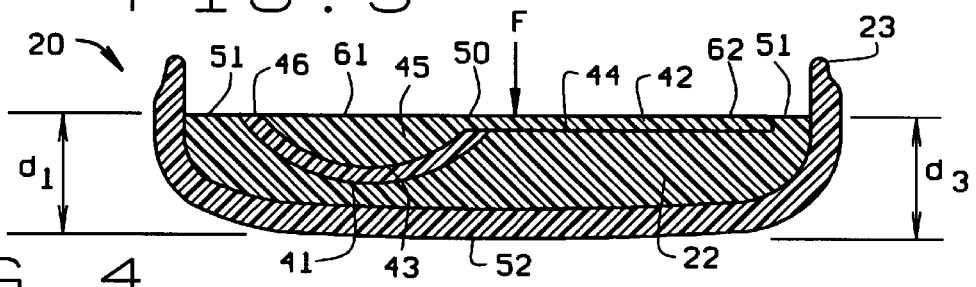
FIG. 4 is a cross sectional view taken along the plane of line 4—4 of FIG. 3 showing the rockable member in a neutral position.

As is illustrated in FIG. 4, the neutral position of the rockable member 45 is a substantially horizontal position in which the top surface 50 of the rockable member is generally flush with the top surface 51 of the sole. Accordingly, the medial and lateral ends of the medial and lateral regions 61, 62 of the rockable member 45 assume approximately equal vertical distances $d_1$, $d_3$ (FIG. 3), respectively, above the bottom surface 52 of the sole. The neutral position of the rockable member 45 accommodates a neutral position of a wearer's foot, such as when a wearer is merely standing. When a wearer stands still, the center of pressure F of the forces applied to the sole via the wearer's foot remains generally in the heel portion 31 of the sole. Hence the pressure applied to the forefoot portion 30 of the sole 20 remains relatively uniform or neutral when the wearer is merely standing, and the rockable member 45 remains in its neutral position as shown in FIG. 4.

As the wearer walks or runs in a straight line, the center of pressure F applied to the sole via the wearer's foot moves generally longitudinally from the heel portion 31 of the sole 20 to the forefoot portion 30 of the sole, passing under the ball of the foot and into the toe region, and then back to the heel portion. In this manner, the center of pressure F stays generally near the longitudinal midline of the sole. Thus, when the wearer walks or runs forward, the center of pressure F of the applied force to the sole passes over the rockable member 45 near the midline of the sole, i.e., along a hypothetical locus of the midpoints of the possible transverse cross sections of the sole. The rockable member bottom surface 44 near the midline of the sole is preferably flat and rests upon the flat portion 42 of the sole cavity 40. Although the rockable member bottom surface 44 and the portion 42 of the sole cavity are described as flat, it is to be understood that other complementary shapes of the rockable member bottom surface 44 and portion 42 of the sole cavity may perform equally well to prevent the rockable member from tilting sidewardly in response to this force. The rockable member 45 therefore maintains its neutral position shown in FIG. 4 when the wearer walks or runs forward. Nearly identical conditions prevent the rockable member from such movement when the wearer walks or runs backward.

Figure 5:
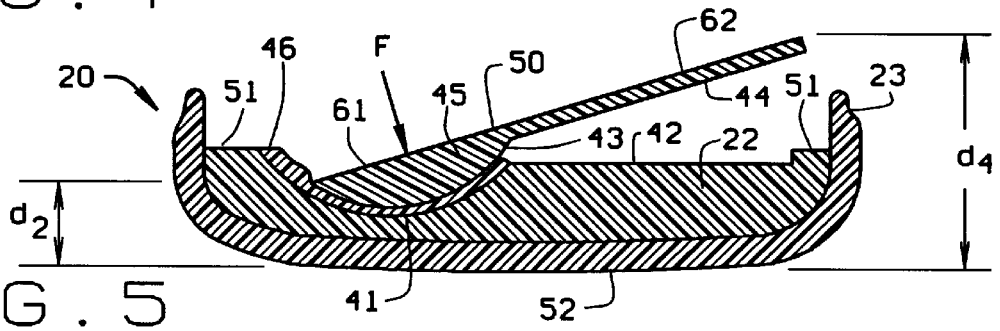
FIG. 5 is a cross sectional view similar to FIG. 4 but showing the rockable member in a tilted position.

Referring now to FIGS. 3 and 5, when the wearer directs sufficient pressure at the proper orientation to the rockable member's top surface 50, such as when the wearer shifts weight to his or her arch (i.e., the medial side of the foot) and to the medial region 33 of the sole 20 (toward the left in FIGS. 3 through 5), the rockable member 45 assumes a tilted position (see FIG. 5) that prevents the foot from sliding over the top surface 51 of the sole. The titled position shown in FIG. 5 is exaggerated for illustrative purposes only. In actual use, the rockable member is likely to be tilted less than 10 degrees when in its tilted position.

When the wearer moves in a manner to shift weight to the arch or ball of his or her foot, i.e. in the general vicinity of the medial region 33 of the sole, the center of pressure F applied to the sole via the wearer's foot moves medially toward the region 60 (FIG. 3) under the first metatarsal-phalangeal joint of the foot. The center of pressure F also orients itself at an angle relative to the top surface of the sole 51 when the wearer shifts weight to the arch or ball of his or foot, producing vertical and horizontal component forces relative to the top surface 51 of the sole at or near the region 60 on the rockable member top surface 50.

The sole cavity 40 is configured to underlie this region 60 so that the rockable member 45 rocks sidewardly on its curved bottom portion 43 against the deformable coupling element 46 in the concave portion 41 of the sole cavity 40 when the center of pressure F of the applied force to the sole contains horizontal components directed toward the lateral region 32 of the sole 20 to the rockable member top surface 50 near the region 60. The side-to-side rocking motion causes the medial region 61 of the rockable member top surface 50 to move below the top surface 51 of the sole, and the lateral region 62 of the rockable member top surface to rise above the top surface of the sole. Accordingly, the end of the medial region 61 of the rockable member 45, i.e., the medial end, decreases from a first vertical distance $d_1$ (FIG. 4) above the bottom surface of the sole 52 to a second vertical distance $d_2$ (FIG. 5), and the end of the lateral region 62 of the rockable member 45, i.e., the lateral end, increases from a third vertical distance $d_3$ (FIG. 4) above the bottom of the sole 52 to a fourth vertical distance $d_4$ (FIG. 5).

Thus, as shown in FIG. 5, the rockable member 45 assumes a tilted position when the user applies pressure to the rockable member at or near the region 60 via the wearer's arch or ball of his or her foot. The tilted rockable member 45 causes the forefoot to rotate medially inward relative to the running surface, thereby reducing the angle of the ankle relative to the forefoot and improving athletic performance. Alternatively, the tilted rockable member 45 accommodates a tilted position of the foot as the wearer shifts his or weight to the arch or ball of the foot to produce the oblique force F. Regardless, the tilted rockable member 45 prevents the forefoot from sidewardly sliding across the top surface of the sole 51, often the source of blisters and foot irritation, and therefore tends to increase the comfort of the shoe.

When the foot center of pressure F returns to the midline of the sole and assumes a predominately vertical orientation perpendicular to the sole top surface 51, such as when the user stands still on a horizontal surface or walks forward in a normal fashion, the concentrated vertical force acting at the midline of the sole directs the rockable member 45 back to its neutral position as shown in FIG. 4.

The rockable member 45 and the sole cavity 40 are preferably configured to allow the rockable member to tilt only in one direction. The flat portion 44 of the rockable member bottom surface engaging the flat portion 42 of the sole cavity 40 prohibits the rockable member 45 from tilting laterally (to the right in FIGS. 3 through 5) beyond the neutral position shown in FIG. 4.

The preferred embodiment of the invention incorporates a properly sized rockable member 45 and sole cavity 40 so that a gap 70 between the rockable member and the sole cavity is not completely closed when the shoe is flexed in the forefoot portion 30 as it is worn. With this configuration, the sole cavity 40 reduces the bending stiffness of the sole 20 in the forefoot portion 30 to enable the sole to more readily flex during use of the shoe. This may increase the comfort of the shoe, and in some cases may further enhance athletic performance itself.

The use of the coupling element 46 in the sole may further enhance the comfort of the shoe of the present invention relative to a conventional shoe. Using a pliable elastomeric material as the coupling element 46 would allow the rockable member 45 to elastically deform downward into the sole cavity 40 as the foot center of pressure passes over the rockable member as the shoe is worn. The deformable coupling element 46 and the gap 70 surrounding the rockable member 45 also allow the rockable member to shift sidewardly to the left and to the right as the center of pressure moves over the rockable member. This downward and sideways movement of the rockable member 45 as the center of pressure moves over it would produce a pillow cushioning effect unlike conventional soles.

Figure 6:
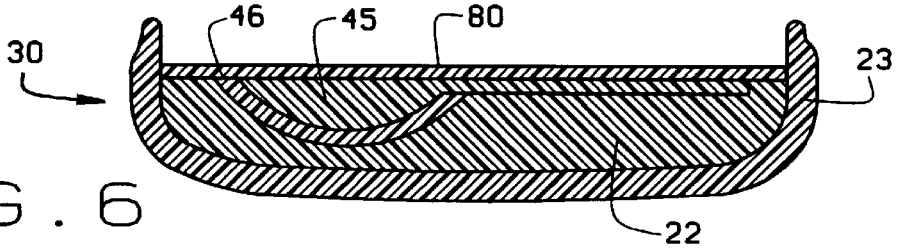
FIG. 6 is a cross sectional view similar to FIG. 4 but showing an embodiment of the invention having a deformable membrane overlaying the sole and rockable member.

Finally, as illustrated in FIG. 6, another embodiment of the invention incorporates a resilient, deformable member 80 overlaying the sole 20 and rockable member 45. Particularly appropriate for this purpose are sock liners. Such a resilient member preferably would be molded together with the coupling element and rockable member with an overmolding process to form a single component piece that is then fitted into the sole cavity and attached to the sole. Alternatively, such a sock liner may be attached or adhered to the sole after the rockable member and coupling elements are in place.

While the present invention has been described by reference to a specific embodiment, it should be understood that modifications and variations of the invention may be constructed without departing from the scope of the invention defined in the following claims.

What is claimed is:

1. A shoe comprising:

a resilient sole for supporting a foot of a wearer, the sole having a heel portion, a forefoot portion, and a cavity;

an upper secured to the sole; and a rockable member within the cavity and configured for side-to-side rocking relative to the sole between a neutral position and a tilted position as the foot of the wearer is moved relative to the sole between a neutral position and a tilted position.

2. The shoe of claim 1 wherein the rockable member substantially spans the lateral width of the forefoot portion of the sole.

3. The shoe of claim 1, wherein the rockable member includes a top surface generally flush with a top surface of the sole when the rockable member is in its neutral position.

4. The shoe of claim 3, wherein a first portion of the top surface of the rockable member is positioned above the top surface of the sole when the rockable member is in its tilted position and a second portion of the top surface of the rockable member is positioned below the top surface of the sole.

5. The shoe of claim 4 further comprising a resilient member overlying the sole and the rockable member.

6. The shoe of claim 5 wherein the resilient member comprises a sock liner.

7. The shoe of claim 6 wherein the rockable member is configured to move to its tilted position when the wearer shifts weight to the arch of the foot.

8. The shoe of claim 1 wherein the rockable member includes a bottom surface having a curved surface portion configured for facilitating rocking of the rockable member between its neutral and tilted positions.

9. The shoe of claim 8 wherein the sole of the shoe includes a curved surface portion generally underlying and adjacent the curved surface portion of the rockable member.

10. The shoe of claim 9 wherein at least one of the curved surface portions is convex.

11. The shoe of claim 9 wherein the curved surface portion of the rockable member is convex.

12. The shoe of claim 9 further comprising a flexible coupling member positioned between and in contact with the curved surface portion of the rockable member and the curved surface portion of the shoe sole.

13. The shoe of claim 12 wherein the flexible coupling member is adhered to the curved surface portions.

14. The shoe of claim 12 wherein the coupling member comprises an elastomeric solid.

15. The shoe of claim 12 wherein the coupling element comprises a gel.

16. The shoe of claim 1 wherein the rockable member is configured to move to its tilted position when the wearer shifts weight to the foot's arch.

17. The shoe of claim 1, wherein the rockable member is positioned relative to the sole of the shoe in a manner so that the rockable member rocks to its tilted position when the user directs pressure to a medial region of the forefoot portion of the sole, and so that the rockable member assumes its neutral position when the user distributes pressure to a lateral region of the forefoot portion of the sole.

18. The shoe of claim 1 wherein the rockable member includes a top surface, the shoe further comprising a resilient member overlaying the sole and bonded to the top surface of the rockable member.

19. The shoe of claim 18 wherein the resilient member is a sock liner.

20. The shoe of claim 19 wherein the sock liner is molded to the rockable member.

21. The shoe of claim 1 further comprising a sock liner configured for overlaying the sole, the sock liner and rockable member constituting a single component piece.

22. A shoe comprising:

a resilient sole for supporting a foot of a wearer, the sole having a heel portion and a forefoot portion;

an upper secured to the sole; and a rockable member within said sole and adjacent the forefoot portion and configured for side-to-side rocking relative to the sole from a neutral position to a tilted position as the wearer shifts weight from a lateral region of the forefoot portion to a medial region of the forefoot portion.

23. A shoe comprising:

a sole having a forefoot portion and a heel portion, the forefoot portion having a medial region and a lateral region, the sole further having an outer bottom surface engageable with a ground surface, an upper secured to the sole;

a rotatable member adjacent the forefoot portion and configured for rotational movement relative to the sole between a neutral position and a tilted position, the rotatable member having a medial end generally adjacent the medial region of the forefoot portion, and a lateral end generally adjacent the lateral region of the forefoot portion, the medial end being spaced a first vertical distance from the bottom surface of the sole when the rotatable member is in its neutral position, the medial end being spaced a second vertical distance from the bottom surface of the sole when the rotatable member is in its tilted position, the second vertical distance being less than the first vertical distance.

24. The shoe of claim 23 wherein the lateral end of the rotatable member is spaced a third vertical distance from the bottom surface of the sole when the rotatable member is in its neutral position, and the lateral end of the rotatable member is spaced a fourth vertical distance from the bottom surface of the sole when the rockable member is in its tilted position, the fourth vertical distance being greater than the third vertical distance.

* * * * *